US006705884B1

(12) United States Patent
McCarthy

(10) Patent No.: US 6,705,884 B1
(45) Date of Patent: Mar. 16, 2004

(54) ELECTRICAL CONNECTOR APPARATUS AND METHOD

(75) Inventor: Dale C. McCarthy, Pensacola, FL (US)

(73) Assignee: Centerpin Technology, Inc., Pensacola, FL (US)

( * ) Notice: Subject to any disclaimer, the term of this patent is extended or adjusted under 35 U.S.C. 154(b) by 0 days.

(21) Appl. No.: 09/640,355

(22) Filed: Aug. 16, 2000

Related U.S. Application Data

(60) Provisional application No. 60/174,446, filed on Jan. 5, 2000, and provisional application No. 60/149,117, filed on Aug. 16, 1999.

(51) Int. Cl.[7] ..... H01R 11/20

(52) U.S. Cl. ..... 439/394; 439/583; 439/584; 439/427

(58) Field of Search ..... 439/394, 583, 439/584, 427

(56) References Cited

U.S. PATENT DOCUMENTS

| | | | |
|---|---|---|---|
| 916,313 | A | 3/1909 | Herrington |
| 1,247,656 | A | 11/1917 | Gadke |
| 1,258,304 | A | 3/1918 | Bishop |
| 1,856,018 | A | 4/1932 | Barth |
| 2,647,246 | A | 7/1953 | Gilbert |
| 2,713,155 | A | 7/1955 | Anderson et al. |
| 2,719,957 | A | 10/1955 | Abbott |
| 2,765,451 | A | 10/1956 | Anderson et al. |

(List continued on next page.)

FOREIGN PATENT DOCUMENTS

| | | |
|---|---|---|
| EP | 0683545 | 11/1995 |
| SE | 178775 | 8/1955 |
| WO | 9734340 | 3/1997 |

*Primary Examiner*—P. Austin Bradley
*Assistant Examiner*—Edwin A. León
(74) *Attorney, Agent, or Firm*—Piper Rudnick LLP; Jefferson Perkins

(57) ABSTRACT

The subject invention relates to an electrical connector for coupling to an insulated electrical conductor or a coaxial cable of the type having an inner conductor enclosed in an inner concentric insulation and having a generally concentric conductive sheath therearound and an outer insulation enclosing the conductive sheath. The subject connector can have a housing having an electrically conductive portion and a bore therein. The subject connector can also have an electrically conductive pin mounted in the housing with one end protruding axially into the housing bore. A second end of the conductive pin can extend in an opposite direction within a second housing bore. The electrically conductive center pin can have a hollow portion extending thereinto from the protruding end and can have an annular sharpened edge on the protruding end. One or more slits can extend along the side of the center pin from the protruding end to form a plurality of center pin segments. Inserting an insulating electrical conductor into the housing bore and into engagement with the hollow center pin drives the center pin into the insulation of the electrical conductor and around the electrical conductor's inner conductor. A segmented center pin can allow the plurality of segments to expand where necessary in order to accommodate various sizes of electrical conductors. One or more conductive arms can be electrically connected to the conductive housing portion and have pointed ends sized for piercing the outer insulation of the insulated electrical conductor. A closure member can be used for forcing and/or securing engagement of the pointed ends of the conductive arms through the outer insulation. For embodiments for use with coaxial cable, the conductive arms are insulated from the electrical conductive pin and the conductive arms are insulated from the electrical conductive pin and the pointed ends of the conductive arms can be shaped relative to one another to pierce the conductive sheath without contacting the center conductor.

49 Claims, 8 Drawing Sheets

U.S. PATENT DOCUMENTS 2,839,595 A 6/1958 Felts et al.
2,887,667 A 5/1959 Wolfe et al.
3,317,883 A 5/1967 Gourley et al.
3,411,129 A 11/1968 Peters
3,444,507 A 5/1969 Gerhard
3,633,147 A 1/1972 Polidori
3,683,320 A 8/1972 Woods et al.
3,744,007 A * 7/1973 Horak ..... 339/97
3,860,320 A 1/1975 Danner
3,951,503 A 4/1976 Caulkins
4,013,333 A 3/1977 Chang
4,091,233 A 5/1978 Berman
4,178,054 A 12/1979 Laudig
4,261,632 A 4/1981 Narozny
4,270,827 A 6/1981 Potgieter
4,339,166 A 7/1982 Dayton
4,352,240 A 10/1982 Komada
4,374,458 A 2/1983 Komada
4,408,822 A * 10/1983 Nikitas ..... 339/177
4,561,179 A 12/1985 Brush, Jr. et al.
4,696,908 A 9/1987 Gutter et al.
4,708,414 A 11/1987 Lam
4,722,579 A 2/1988 Cummings et al.
4,739,126 A 4/1988 Gutter et al.
4,759,722 A 7/1988 Song
4,770,642 A 9/1988 Van Hoose
4,786,760 A 11/1988 Friedhelm
4,789,355 A * 12/1988 Lee ..... 439/263
4,968,268 A 11/1990 Oh
5,052,946 A 10/1991 Homolka
5,066,248 A 11/1991 Gaver, Jr. et al.
5,263,878 A 11/1993 Lai
5,318,458 A 6/1994 Thorner
5,362,251 A 11/1994 Bielak
5,403,201 A 4/1995 McCarthy
5,503,568 A 4/1996 Pryce
5,564,942 A 10/1996 Lee
5,569,049 A 10/1996 Tatebe et al.
5,573,423 A 11/1996 Lin et al.
5,607,320 A * 3/1997 Wright ..... 439/394
5,704,814 A 1/1998 McCarthy
5,775,934 A 7/1998 McCarthy
5,913,694 A 6/1999 Wright
5,934,937 A 8/1999 McCarthy
5,934,943 A 8/1999 McCarthy
RE36,700 E 5/2000 McCarthy
6,062,897 A 5/2000 McCarthy
6,102,737 A 8/2000 Gohdes
6,109,694 A 8/2000 Kurtz
6,109,964 A 8/2000 Kooiman
6,123,567 A 9/2000 McCarthy
6,126,491 A 10/2000 McCarthy
6,168,455 B1 * 1/2001 Hussaini ..... 439/394
6,244,892 B1 6/2001 McCarthy
6,261,137 B1 * 7/2001 Wilcox ..... 174/84 C

* cited by examiner

ELECTRICAL CONNECTOR APPARATUS AND METHOD

CROSS-REFERENCE TO RELATED APPLICATIONS

This application claims priority to provisional application Ser. No. 60/174,446, filed Jan. 5, 2000 and provisional application Ser. No. 60/149,117, filed Aug. 16, 1999.

BACKGROUND OF THE INVENTION

The present invention relates to electrical connectors. In specific embodiments, the subject invention pertains to an electrical connector for coupling to an insulated electrical coaxial cable or single conductor cable. In a typical connector, the end of the wire is stripped of insulation and the bare wire is inserted into a connector where it can be soldered or clamped or otherwise attached to the connector.

U.S. Pat. No. 5,403,201 discloses electrical connectors of the type including a center pin. The center pins shown in the U.S. Pat. No. 5,403,201 are of solid conductive material and engage the center wire of an electrical conductor by piercing the wire if it is multi-strand or engaging it on the side if it is single strand. In the latter case, the electrical connection can be quite good but necessarily only as good as the area of contact between the center pin of the electrical connector and the single strand wire of the electrical conductor and the pressure of engagement at the area of contact.

It is an object of the present invention to improve the center pin type of electrical connector so as to increase the integrity of the electrical connection between the center pin of the connector and the single strand wire of an electrical conductor while at the same time allowing the use of the connector with electrical conductors having multi-strand center wires.

BRIEF SUMMARY OF THE INVENTION

The subject invention pertains to an electrical connector and a method of coupling an electrical connector to an insulated electrical conductor. An electrical connector in accordance with the invention can comprise a housing and an electrically conductive center pin or prong mounted thereto for engaging the center wire of an insulated electrical conductor. The attachment of the center pin or prong to the housing is such that the center pin is electrically insulated from the housing. The housing can incorporate a center bore with the conductive center pin mounted therein such that an end of an insulated electrical conductor can be inserted into the bore. This center bore can, in certain embodiments, help to guide an insulated electrical conductor into engagement with the center pin. Preferably, the center pin is mounted in the housing such as to protrude toward the open end of the center bore. The center pin can be of solid design or can have one or more hollow portions. In a specific embodiment, the center pin is hollow and open at its exposed end for engaging the center wire of an insulated electrical conductor. Preferably, but not necessarily, the hollow portion of the center pin also incorporates one or more longitudinal slits extending along its side wall. These slits can allow for expansion of the end of the hollow portion of the center pin upon receipt of an electrical conductor which, for example, may be larger in outer diameter than the inner diameter of the hollow end of the center pin. The edge of the receiving end of the hollow portion of the center pin can be beveled and/or sharpened to enhance the ability of the hollow portion of the center pin to squeeze between the center conductor of the insulated electrical conductor and the adjacent insulation layer.

The subject electrical connector can also be utilized with coaxial cable or other insulated electrical conductors which incorporate a center conductor and an outer electrical conductor concentric with such that the outer electrical conductor is separated from the center conductor by a layer of insulation. In a specific embodiment for use with coaxial cable, a center pin makes electrical contact with the center conductor of the coaxial cable and the housing is provided with a means for making electrical contact with the outer electrical conductor. For example, one or more clamping members can be incorporated in the subject electrical connector which can penetrate the outer layer of insulation and make electrical contact with the outer electrical conductor. In an alternative embodiment of the subject invention, the center pin or prong can be substituted for by stripping the insulated electrical conductor such that the center conductor protrudes from an otherwise flush end of the insulated electrical conductor and projects into the connector housing in the place of the center pin.

DETAILED DISCLOSURE OF THE INVENTION

Figure 1:
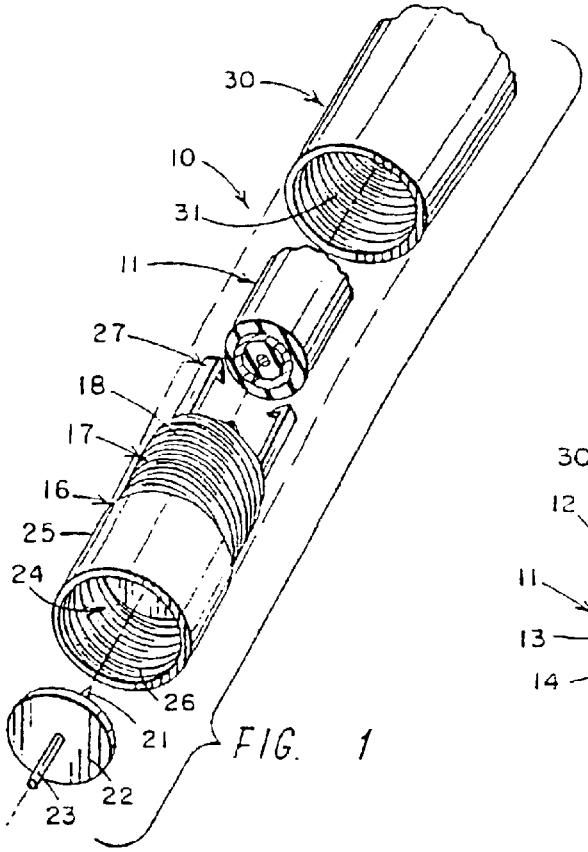
FIG. 1 is an exploded view of an electrical connector and a portion of a coaxial cable in accordance with the present invention.
Figure 2:
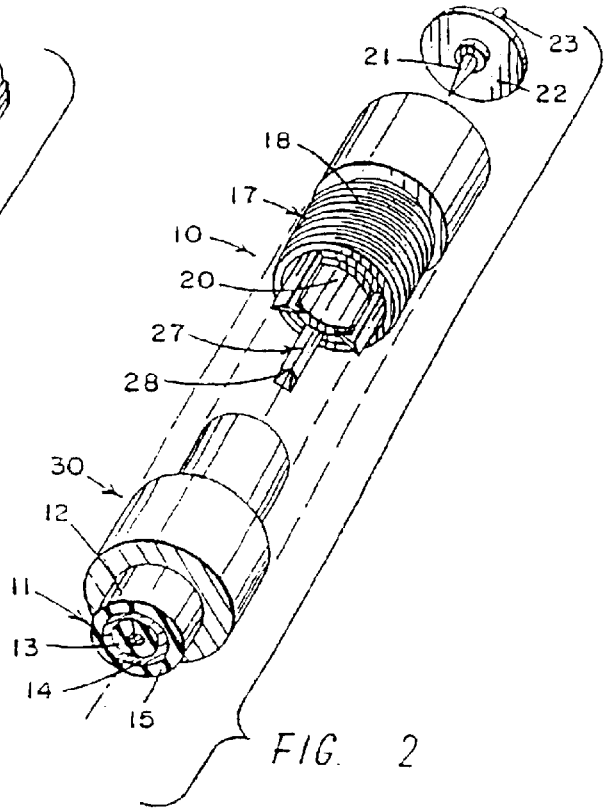
FIG. 2 is an exploded view of the electrical connector of FIG. 1 but looking in the opposite direction and having the coaxial cable inserted into the housing cap which has been sectioned for clarity.

Referring to FIGS. 1–4 of the drawings, an electrical connector 10 in accordance with the subject invention, especially adapted for use with a coaxial cable 11, is illustrated. The coaxial cable 11 has a center conductor 12, a surrounding concentric insulation 13, a concentric conductive wire braid or sheath 14 surrounding the insulation 13; and an outer insulation 15 covering the conductive sheath 14. Connector 10 can be adapted to connect a variety of types and sizes of coaxial cables to a variety of plugs, jacks, and connectors, all referred to herein as electrical connectors. Illustrated in FIGS. 1–4 for purposes of describing a specific embodiment of the subject invention is the male part of a 75 ohm coaxial F-connector. Connection of the coaxial cable 11 to connector 10 can be accomplished without solder and without the need to strip the insulation cover 15 from the cable.

Figure 3:
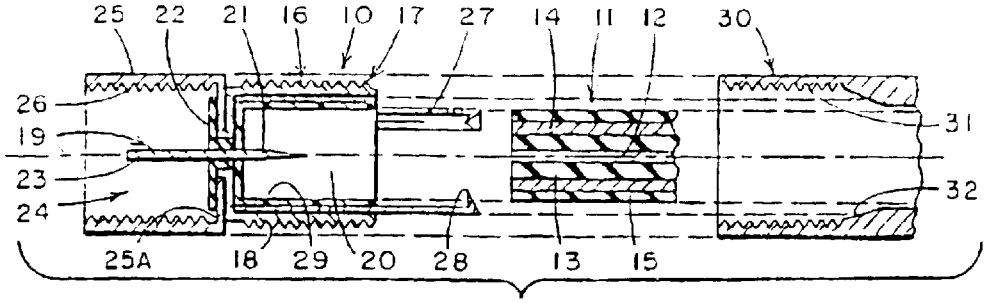
FIG. 3 is a sectional exploded view of the electrical connector of FIGS. 1 and 2.
Figure 4:
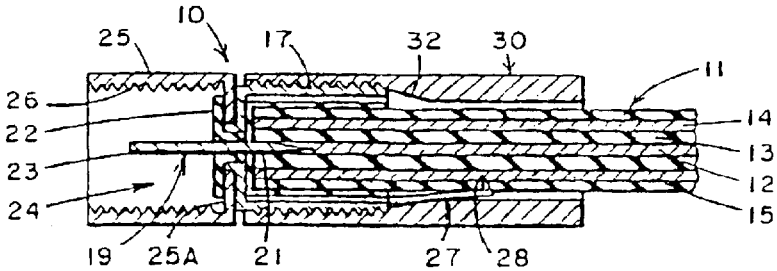
FIG. 4 is a sectional view of the electrical connector of FIG. 3 having a coaxial cable end attached thereto.

Connector 10 as illustrated in FIGS. 1–4 includes a connector housing 16 having a cylindrical cable attaching portion 17 which external threads 18 defining a first chamber 20 and a cylindrical housing portion 25 with internal threads 26 defining a second chamber 24. An electrically conductive pin 19 is mounted to an insulation base 22 within the housing 25 with the base 22 abutting and being secured to a wall portion 25A. The conductive pin 19 has a tapered prong 21 extending axially into the bore defining the first chamber 20 and also has a cylindrical prong 23 extending axially into the bore defining the second chamber 24. Electrically conductive arms 27 extend axially from the cable attaching portion 17 of the housing 16. Each arm has pointed contacts 28 which are also electrically conductive. A plurality of clamping arms 27 are contemplated but a single arm can perform the operation of attaching the coaxial cable 11. A locking cover 30 is a generally cylindrical conductive member having internal threads 31 adapted to engage the external threads 18 of the connector body portion 17. The cap 30 has a central bore to receive the coaxial cable and an annular, frustoconically angled wedging portion 32 formed therein. FIG. 3 also shows a cup-shaped insulation covering 29 received within the connector housing 16 which provides extra security against contact of the conductive sheath 14 with the connector body 16 metal portions in the event a stray strand of wire from conductive sheath 14 should extend from the cable 11.

In operation, the tip of the coaxial cable 11 does not have any of the insulation stripped from the conductors 12 or 14 as is normally required to connect a coaxial cable to a connector. The undisturbed end of the coaxial cable 11 is slidably inserted between the clamping members 27 and into the bore 20. Sufficient force is provided to push the cable 11 onto the prong 21 and into electrical contact with the center conductor 12. The electrical conductive contact with the coupling stem portion 19 provides electrical continuity to the probe 23. The connector 10 can then be attached to an electrical apparatus, such as a television set or the like, or to another coaxial cable.

Once the coaxial cable 11 is pushed into the bore and attached into electrical contact with the prong 21, the ends of the arms 27 may be clamped to drive the pointed contacts 28 through the outer insulation 15 into the conductive sheath 14. This may be accomplished manually, by hand or with pliers, in clamping the ends of the arms 27 to force the pointed contacts 28 through the outer insulation 15 of the coaxial cable 11 into the concentric conductive sheath 14 to make an electrical contact therewith.

Alternatively, and in carrying out the same function, the ends of the arms 27 may be clamped by installing the housing cap 30 onto the threads 18 of the housing portion 17 so that wedging portion 32 drives against the ends of the clamps to drive the pointed contacts 28 through the outer insulation 15 and into the conductive sheath 14. If done manually, the next step is to maintain the cable and the arms 27 in contact by, for example, threading the cap into place or utilizing the heat shrink embodiment, as shown in FIGS. 5, 6, and 7.

Figure 5:
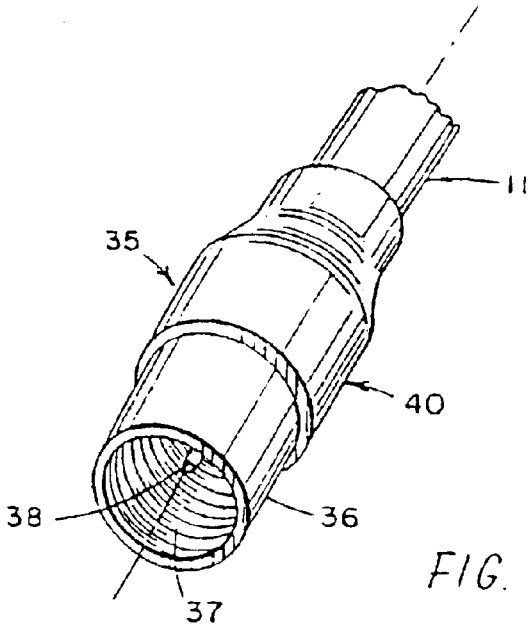
FIG. 5 is a perspective view of another embodiment of a coaxial cable connector in accordance with the present invention.
Figure 6:
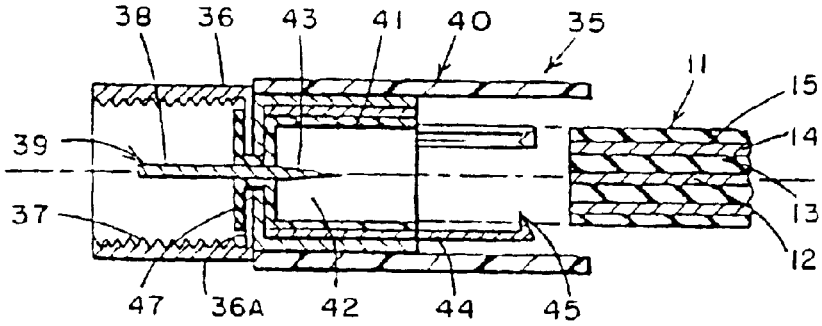
FIG. 6 is an unexploded sectional view of the connection of FIG. 5.
Figure 7:
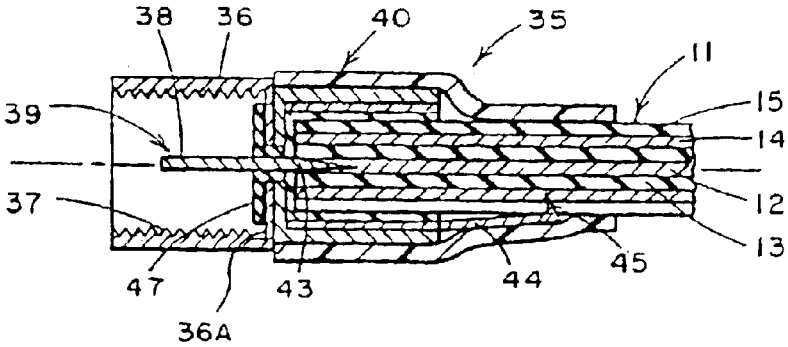
FIG. 7 is a sectional view of the embodiment of FIGS. 5 and 6 having the cable attached thereto.

Turning now to FIGS. 5, 6 and 7, another embodiment of a coaxial cable connector is illustrated in which an electrical connector 35 has an electrically conducting connector body 36. In FIG. 7, the connector 35 has a coaxial cable 11 attached to one end thereof. The other end of the connector 35 has internal threads 37 with a center conductor 39 having a cylindrical conductor portion 38. In this embodiment, a heat shrinkable insulating sleeve 40 is attached to the conductive connector housing portion 41. A pointed prong 43 on the stem 39 is disposed in a chamber 42. The pointed prong 43 is provided for insertion into electrical contact with the center conductor 12 of a coaxial cable 11. A plurality of clamping arms 44 are connected to the conductive housing 41 and each arm 44 has a pointed prong 45 extending radially inward from the end thereof.

Coaxial cable 11 has electrical insulation 13 around the center conductor 12 which is covered by the concentric conductive sheath 14 which in turn is wrapped in insulation cover 15. In operation, the coaxial cable 11 end is inserted into an opening 46 in the insulation 40 between the clamping arms 44 and prongs 45. The prong 43 is driven into or continuously adjacent the center conductor 12 thereby making electrical contact therewith.

The center conductor 12 on coaxial cable is sometimes a single conductor wire and sometimes is formed of multiple strands so that the prong 43 will sometimes be driven into the multiple strand wire and at other times be directed adjacent to the single wire conductor 12.

Once the cable 11 is inserted and is in conductive contact with the prong, the arms 44 are clamped manually by hand or with a tool so as to cause the pointed prongs 45 to pierce the outer insulation 15 and make conductive contact with the conductive sheath 14. Alternatively, the heat shrinkable insulation 40 is heated which causes it to shrink tightly onto the housing 41 on onto the cable 11 and the arms 44. This shrinkage can push the pointed prongs 45 of arms 44 through the outer cover 15 and into electrical contact with the conductor member 14. In the case of the alternative and to further assure proper contact, the insulation 40 can be pressed by the assembler onto the clamp members 44 to set the prongs 45 through the insulation 15 and into the conductor 14. The insulating sleeve 40 thus holds the connector 35 to the cable 11 while forming an insulation for the tip of the cable. The arms 44 also lock into the cover 15 to hold the cable in place with the conductive prong 43 making contact with the conductor 12 of the cable 11. This provides the center conductor 38 with a contact with the cable 11. The prongs 38 and 43 are mounted to an insulating member 47 which is attached to a wall 36A of the body 36.

Figure 8B:
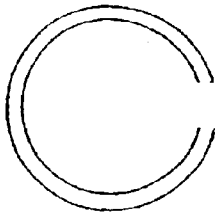
FIG. 8B shows an end cross-sectional view of the hollow portion of the pin shown in FIG. 8A.
Figure 8A:
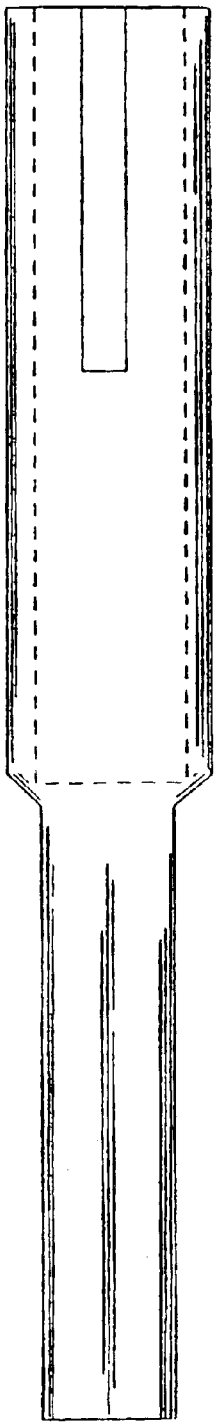
FIG. 8A illustrates a side view of a conductive pin in accordance with the subject invention, incorporating a hollow portion having a single slit.
Figure 9B:
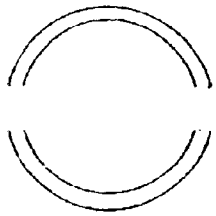
FIG. 9B shows an end cross-sectional view of the hollow portion of the pin shown in FIG. 9A.
Figure 9A:
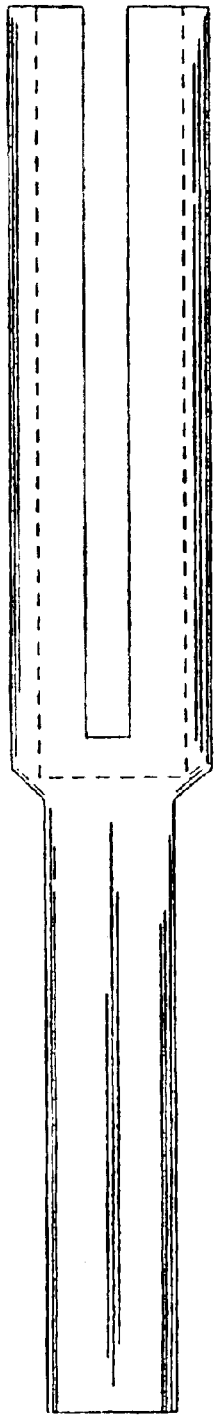
FIG. 9A illustrates a side view of a conductive pin in accordance with the subject invention, incorporating a hollow portion having two slits.

Referring to FIGS. 8A, 8B, 9A, and 9B, specific embodiments of a pin which can be utilized with respect to the electrical connectors of the subject invention is shown. For example, either pin shown in FIGS. 8A and 9A, or variations thereof, can be incorporated with the electrical connectors shown in FIGS. 1–4 and FIGS. 5–7. Both FIGS. 8A and 9A show side views of pins having a hollow portion on one end for receiving an electrical conductor and a solid portion for connecting with and an external apparatus on the other end. Other pin embodiments are possible which, for example, have a solid portion at each end of the pin (as in FIGS. 1–4) or have a hollow portion at each end of the pin. In addition, the entire pin can be hollow if desired. Preferably, the hollow portion of each pin can have one or more slits. The number, lengths, and widths, of the slits can vary depending on the application. FIG. 8A shows a slit which extends about half the length of the hollow portion of the pin, while FIG. 9A shows two slits which extend essentially the entire length of the hollow portion of the pin. FIGS. 8B and 9B show end views of the hollow portions of the pins shown in FIGS. 8A and 9A, respectively. These slits can allow the hollow portion to expand to just the right size to receive an electrical conductor such that a good electrical contact can be made.

Figure 10:
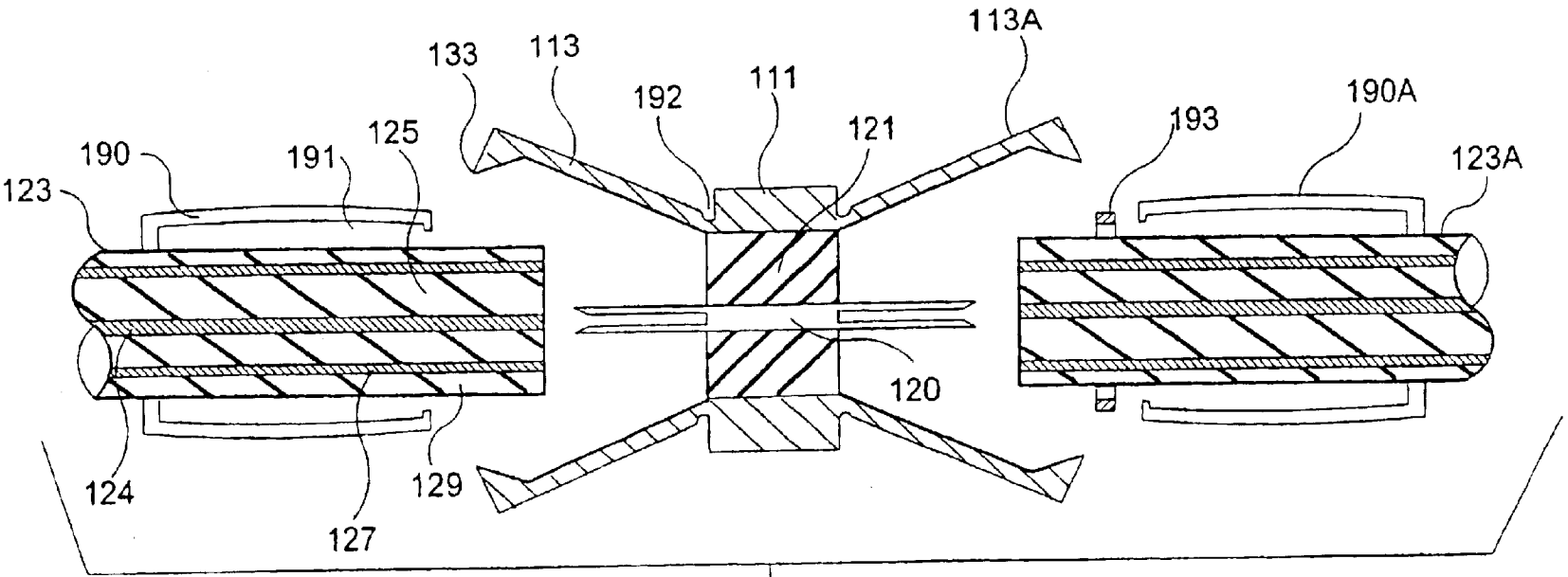
FIG. 10 illustrates a cross-sectional view of an electrical connector in accordance with the subject invention.
Figure 11:
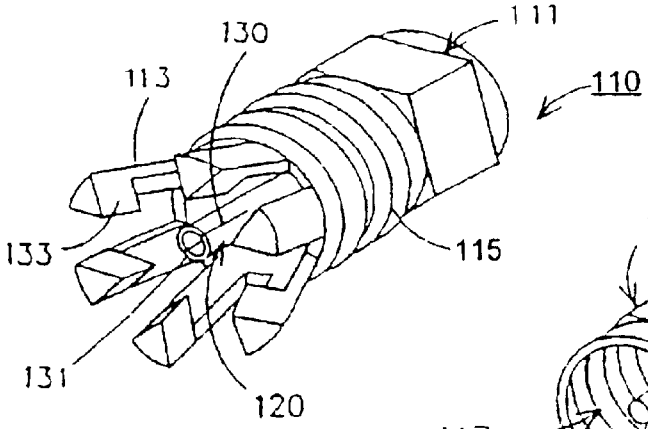
FIG. 11 is a perspective view of an electrical connector in accordance with the present invention.
Figure 12:
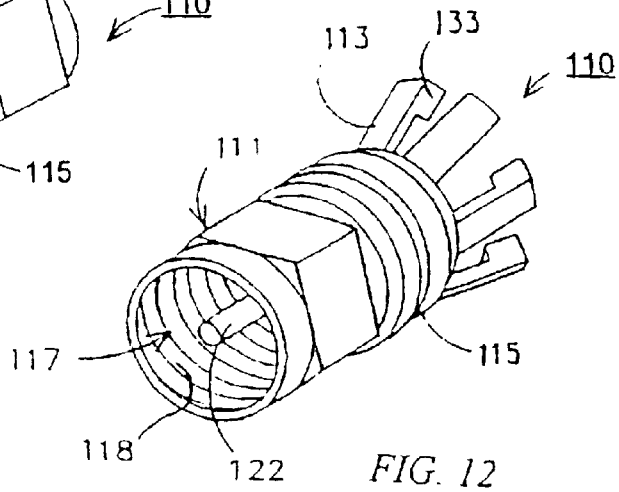
FIG. 12 is a rear perspective view of the electrical connector of FIG. 11.

FIG. 10 shows an electrical connector in accordance with the subject invention. This connector incorporates a pin 120 which has a hollow portion at each end for engaging a center conductor 124 of a coaxial cable 123. In another embodiment, pin 120 can be designed, as in FIGS. 15 and 16, to accept a center conductor of an insulated wire. In addition, one or both ends of pin 120 could be a solid pin as shown in FIGS. 1–4, depending on the application. Pin 120 is attached to housing 111 via base 121 which electrically isolates pin 120 from housing 111. In the embodiment shown in FIG. 10, base 121 extends to the edge of the bore where clamping arms 113 protrude from housing 111. Narrowing the axial length of base 121 in this embodiment can allow a shorter length from the tips 133 of clamping arm 113 to the center of housing 111, such that propagation losses can be reduced. The reduction in propagation losses can potentially enable the use of the connector for higher frequency signals. Pin 120 is shown as a solid pin through the region of base 121, but could be hollow through a portion of, or all of, this region. The width of base 121 can be reduced to optimize the performance of the connector. As the width of base 121 is reduced, the width of housing 111 can also be reduced accordingly.

Preferably, a cover or cap can be used to, for example, protect the electrical connections made and/or help maintain clamping arms 113 in position once they have penetrated insulation layer 129 to make electrical contact with conductor 127. In the embodiment shown in FIG. 10, cap 190 is shown as a snap-on cap. Lip 191 of cap 190 is designed to settle into indentation 192 on housing 111. Other designs for cap 190 can be utilized depending on the application. If desired, o-rings, or other equivalent means, can be incorporated with the use of cap 190 to protect the connection from moisture and other environmental conditions and/or to enhance the performance of the cap. Alternatively, the connector shown in FIG. 10 can be utilized without cap 190.

In a further variation, the arrangement of FIG. 10 may be provided with a sleeve 193 which fits over the arms 113A after they have been clamped into place in the cable 123A in order to secure the arms to the cable 123A. Sleeve 193 can be made, for example, of metal, or other appropriate materials. In that arrangement the cap 190A can be just like the cap 190 or it can be a sleeve or a cap of heat shrink material, that would for example, seal the connection between the cable and the connector. In a manufacturing operation in which the cable is connected to the connector, the cap 190A could be of molded plastic which would secure the arms to the cable 123A in which case the use of the ring 193 might not be necessary. In addition, rubber molded coverings can be utilized with the subject connector to cover and hold clamping arms 113 in place.

Referring to FIGS. 11–14, a specific embodiment of an electrical connector in accordance with the subject invention is illustrated. Electrical connector 110 has a housing 111. Preferably, as shown in FIGS. 11–14, housing 111 can have a bore 112 extending thereinto. An insulated electrical conductor can be guided into bore 112 to assist in aligning pin or prong 120 with the center conductor of the insulated electrical conductor. One or more clamping arms 113 can extend from end 114 of housing 111. Clamping arms 113 can be pressed into the outer insulation layer 129 of an insulated electrical conductor 123, the center conductor of which is in contact with center pin 120, to make electrical contact with a second electrical conductor 127 of conductor 123. A cover and/or means for holding clamping arms 113 in place can be incorporated with the subject connector. In the embodiment shown in FIGS. 11–14, external threads 115 can be located on housing 111 to receive a threaded cap. Other types of caps and cap attachment mechanisms are also possible. Insulated base 116 can attach center prong 120 to the housing such that the center pin is electrically insulated from housing 111.

Once electrical contact is made between center pin 120 and center conductor 124, and optionally between housing 111 and second conductor 127, a variety of designs can be used to enable the connection of connector 110 to other apparatus. For example, a symmetric design can be utilized to connect to a second insulated electrical conductor identical to conductor 123 to form a coupler. A second pin 122 can extend from the housing and be in electrical contact with pin 120 such that pin 122 is in electrical contact with center conductor 124. Other means for allowing an external apparatus to make electrical contact with center conductor 124 can also be used. In the embodiment shown in FIGS. 11–14, pin 122 allows electrical contact with center conductor 124 while housing 111 allows electrical contact with second conductor 127. Specifically housing 111 can have a second bore 117, which can extend from the opposite side of the base 116. Second bore 117 can have internal threads 118 for attaching the connector to an externally threaded member.

Figure 13:
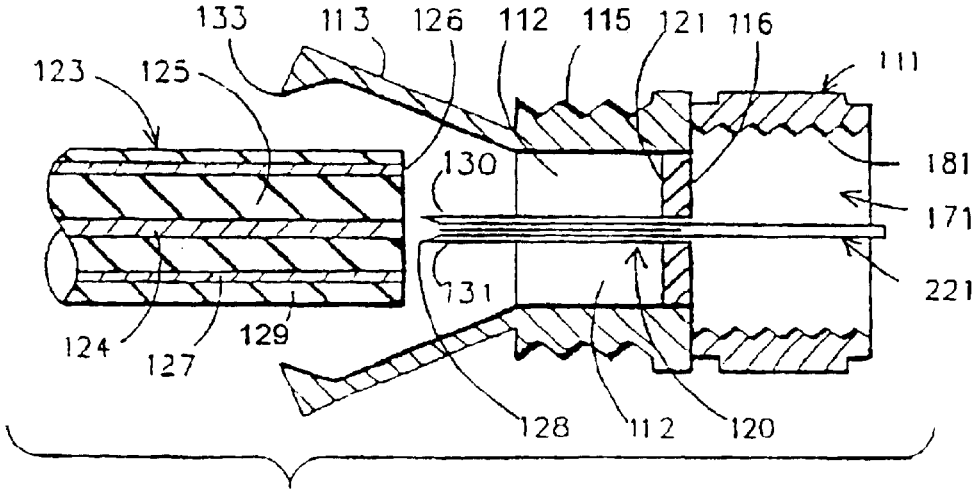
FIG. 13 is a side sectional view of the electrical connector of FIGS. 11 and 12 having an electrical conductor being inserted thereinto.
Figure 14:
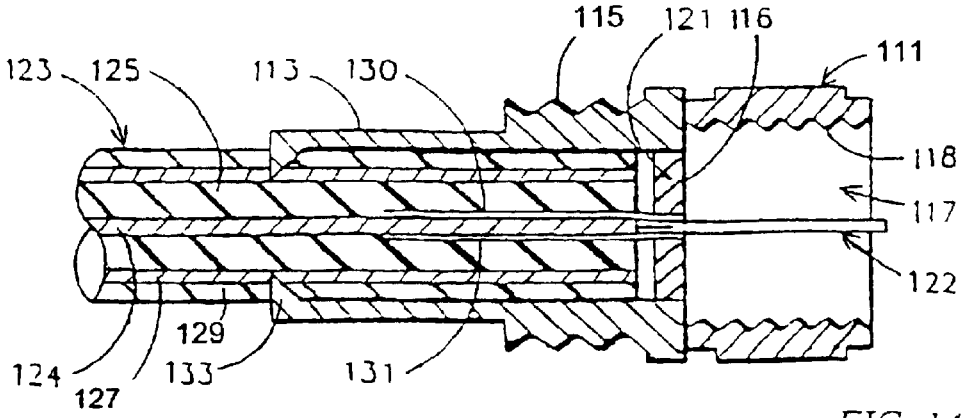
FIG. 14 is a sectional view of the electrical connector of FIG. 13 having an electrical conductor attached thereto.

Center pin or prong 120 can extend axially from housing 111 and, as shown in the embodiment shown in FIGS. 11–14, can extend past the end of bore 112. Alternatively, the end of prong 120 can be within bore 112. Prong 122 can be attached to base 121, insulating prong 122 from the outer conductive portion of housing 111. Prongs 120 and 122 can be one continuously conductive prong, as illustrated in FIGS. 13 and 14. According electrical contact can be made between the center conductor contacted by prong 120 and a electrical conductor contacting prong 122. Attaching prong 122 may be a solid member, as illustrated, or can be a hollow prong similar to prong 120.

Conductive prong 120 is shown in FIG. 13 just prior to engaging with insulated electrical conductor 123 having a conductor 124 surrounded by a concentric insulating layer 125, concentric conductor 127, and outer concentric insulation layer 129, such that a hollow portion of prong 120 will surround and makes electrical contact with center conductor 124 as end 126 of conductor 123 is inserted into bore 112. Prong 120 has a hollow portion beginning at prong end 128 and extending at least as far as conductor 123 may be inserted. Preferably, as shown in FIGS. 11–14, the hollow portion of prong 120 can have one or more slits extending from end 128 of prong 120 as far up as desired. The slits along the sides of the prong 120 can form one or more prong segments 131. Preferably, prong 120 has two prong segments 131 with sharpened edges and can expand to accommodate different sizes of electrical conductors 124 located inside the insulation. The edge 128 of end 126, namely the end edges of prong segments 131, can be sharpened and/or beveled in either direction, to enhance the ease of insertion between center conductor 124 and insulation layer 125.

At least one, and preferably all arms 113 have an insulation engaging tip 133. This tip can be angled and/or have a sharpened edge, as shown in FIGS. 11–14, for penetrating and clamping onto the insulated wire 123. Once the insulated conductor 123 is engaged with conductive prong 120, as show in FIG. 14, clamping arms 113 can be pushed toward insulated conductor 123 such that tips 133 enter insulation layer 129 of the wire 123, to make electrical contact with conductor 127. This can be done, for example, manually with a person's fingers, with a pair of pliers, or with a special tool for driving tips 133 into the insulation.

Figure 21:
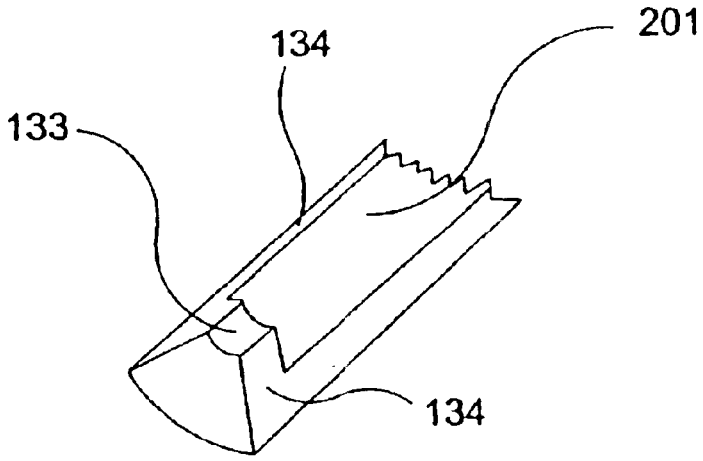
FIG. 21 shows a specific embodiment of an individual clamping arm broken away from the housing.

The driving tips of the clamping arms can take on a variety of shapes to optimize electrical contact with conductor 127 and the ability to withstand pulling forces on conductor 123 with respect to connector 110. Referring to FIG. 21, a single clamping arm 113 broken away from housing 111 is shown. The pointed end 133 of clamping arm 113 can have a variety of shapes, in order to optimize one or more operational characteristics of the subject electrical connector. In the embodiment shown in FIG. 21, pointed end 133 is shaped such that as the clamping arms are manipulated to cause the piercing of the outer insulation, the sides 134 of the clamping arms come in contact with the adjacent clamping arms such that contiguous encasement with adjacent clamping arms act to prevent further penetration of the pointed end 133.

Figure 20:
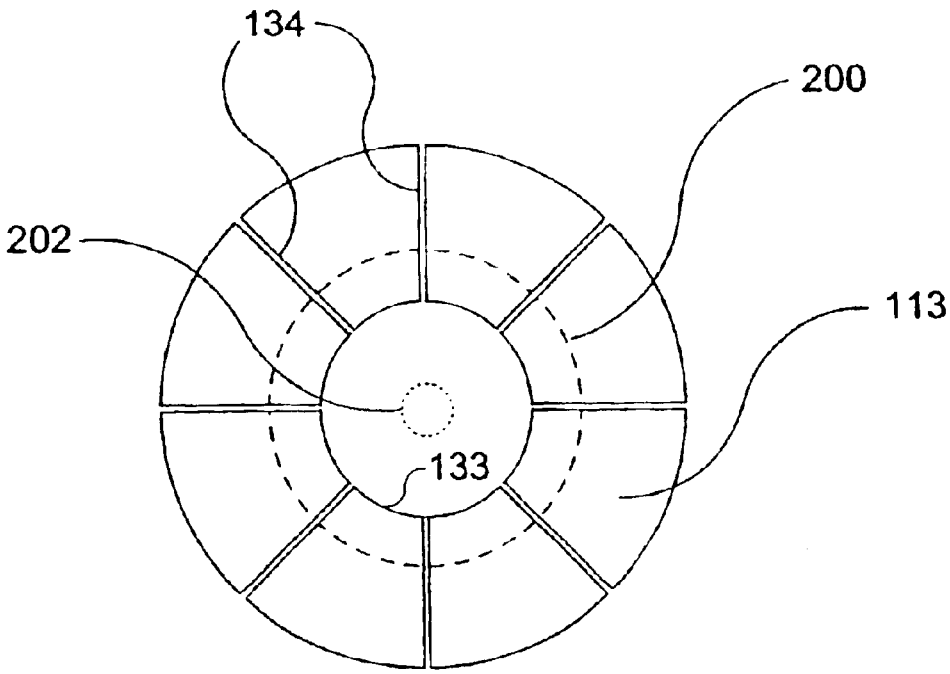
FIG. 20 shows an end view of an electrical connector in accordance with the subject invention having eight clamping arms which have been manipulated into the clamped position.

FIG. 20 shows an end view of an embodiment having eight clamping arms, as shown in FIG. 21, which have been clamped into place. Dashed line 200 represents the position of surface 201 of the clamping arms. Preferably, the clamping arms 113 are designed such that surface 201 contacts the surface of the outer insulation of the coaxial cable when the clamping arms are clamped in place. In this embodiment, surface 201 is curved to match and engage the circumference of the outer insulation of the coaxial cable. In this way, the clamping arms 113 contact the outer insulated conductor of the coaxial cable over almost its entire circumferential surface. This large surface area of contact can help to hold the coaxial cable in place. If desired, knurling or other alterations to the surface texture of surface 201 can be made to increase the frictional forces between surface 201 and the coaxial cable. The distance past surface 201 which pointed end 133 protrudes, and therefore will penetrate into the coaxial cable, can be selected such as to optimize one or more performance characteristics of the subject connector. For example, the amount of protrusion of end 133 can be adjusted such that end 133 contacts but does not penetrate the conductive sheath, just barely penetrates through the conductive sheath, or penetrates through the conductive sheath and into the inner insulation of the coaxial cable.

The curve of the end 133 can also be selected to optimize the performance of the connector. In FIG. 20, the curve of end 133 is selected such that the eight ends form a circular pattern of deepest penetration into the conductive sheath of the coaxial cable. This circular pattern can help to reduce reductions in the quality of the electrical signal caused by the electrical connector. The dotted circle in the center of FIG. 20 represents the approximate location of the inner conductor of the coaxial cable. The shape of the protruding end 133 can also be adjusted to optimize the degree to which the clamping arms can hold the coaxial cable in the connector, to assist when the cable is pulled with respect to the cable.

Preferably, a cap can be used to hold arms 113 in place once they are driven into the insulation. This cap can be designed to further push tips 133 into the insulation as the cap is positioned. Such a cap can utilize one of a variety of designs. For example, the cap can slide over clamping arms 113 and lock into place on housing 111, thread onto the housing, fold together and snap, or utilize a heat shrinkable material, to hold itself in position. In a specific embodiment, a closure cap can have insulated conductor 123 passing there through, and fit over the arms 113 to attach to external threads 115, holding the clamping arms 113 in position with respect to insulated conductor 123. In a specific embodiment of the subject connector, losses associated from the connector can be reduced by having no bore 112 but, rather having clamping arms 113 extend directly from the portion of housing 111 adjacent base 121 such as to reduce the distance between tips 133 and base 121. If desired, a ridge can be provided for a snap-on cap to snap onto and hold arms 113 in place.

Figure 15:
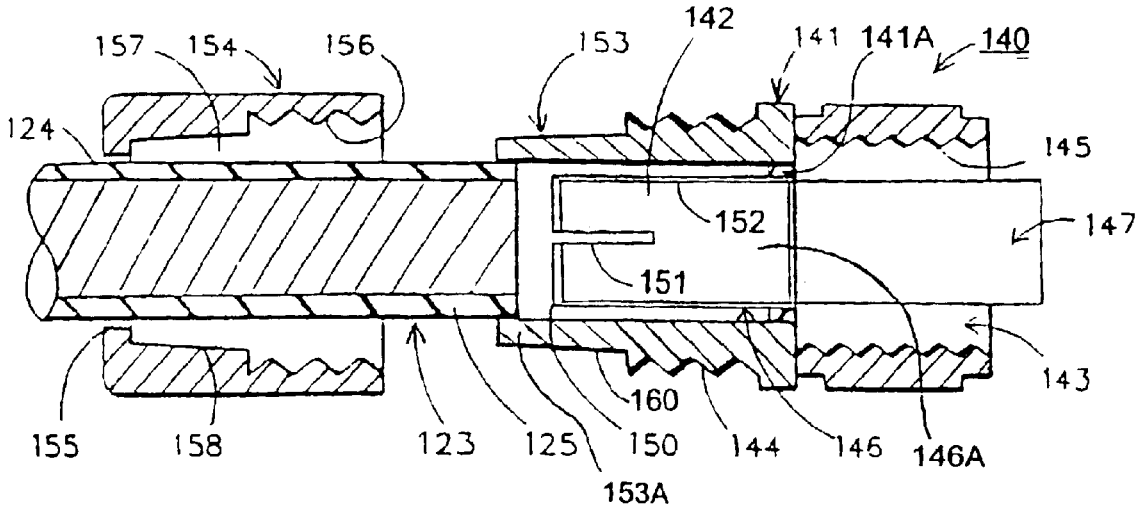
FIG. 15 is a sectional view taken through a second embodiment of an electrical connector of the present invention having an electrical conductor inserted into the connector bore.
Figure 16:
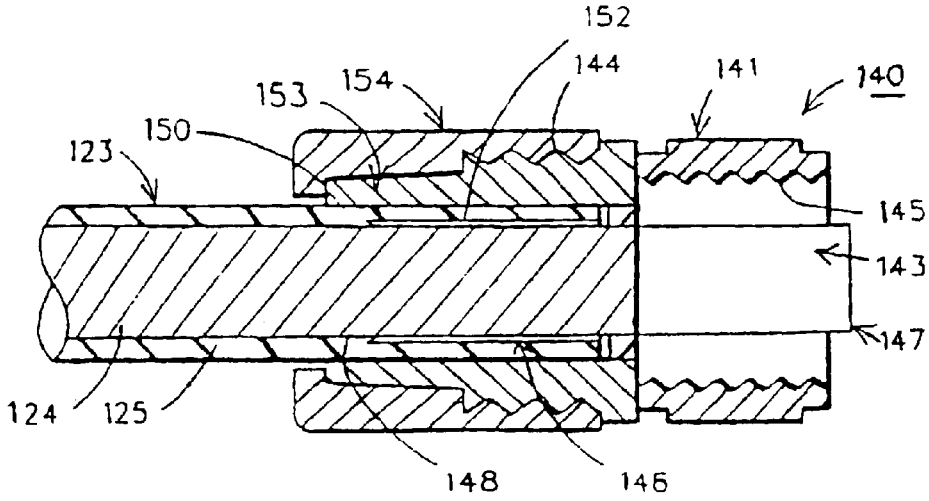
FIG. 16 is a sectional view of the electrical connector of FIG. 15 having an electrical conductor attached thereto.

Turning to FIGS. 15 and 16, a specific embodiment of an electrical connector 140 for coupling to a center conductor having an outer insulation layer is illustrated. The connector shown in FIGS. 15 and 16 has a housing 141 having a bore 142 in one end thereof and a bore 143 extending into the other end of the housing 141. The housing can have external threads 144 on one end thereof and internal threads 145 extending into the bore 143. A center conductive prong 146 extends axially into the bore 142 and a conductive prong 147 extends axially into the bore 143. Prongs 146 and 147 are electrically connected and can be one continuous prong supported in the housing 141 by collar 141A. Prong 146 has a hollow portion 146A extending from end 150 to receive a center conductor 124. The hollow portion 146A of prong 146 is not required to have but may have a single slit 151, or a plurality of slits in the side thereof to, for example, allow prong 146 to expand as a center conductor enters. Slits 151 can extend the entire length of the hollow portion of prong 146 or any portion thereof. If prong 146 has two or more slits, the slits can divide the end of the prong 146 into a plurality of segments 152. In the embodiment shown in FIGS. 15 and 16, end 150 has been beveled inwardly to allow the segments to more easily drive in between center conductor 124 and insulation layer 125 of the insulated electrical conductor 123. If desired, end 150 can be beveled in the opposite direction or sharpened on both sides.

The insulated electrical conductor 123 is shown being inserted into bore 142 in FIG. 15, and attached to connector 140 in FIG. 16. The portion of housing 141 surrounding bore 142 can be sufficiently large in diameter to allow the insulated conductor to be inserted into bore 142 with the hollow portion of prong 152 squeezing between center conductor 124 and insulation layer 125. Preferably, the open end portion of housing 141 surrounding bore 142 can have one or more slits 153A extending from the end of housing 141 which can create one of more clamping arms 153. Preferably, slits 153A can extend up to the threaded portion 144 and may extend into the threaded portion 144, if desired. Extending from housing 141, clamping arms 153 can be dimensioned to allow the insulated conductor sufficient room to enter bore 142 and allow hollow prong 152 to enter between center conductor 124 and insulation layer 125. After the insulated conductor is correctly positioned within bore 142, threading of the cap 154 onto the housing 141 can cause the clamping arms 153 to clamp the electrical conductor 123. This can help to hold the electrical connector and insulated electrical conductor together.

In a preferred embodiment, a cap can be placed over clamping arms 153 to hold them to insulation layer 125. In the embodiment shown in FIGS. 15 and 16 closure cap 154 has an open end 155 for passing the electrical conductor 123 therethrough and has internal threads 156 within passageway 157 for attaching to threads 144 of housing 141. The inside annular surface 158 may be angled for wedging against an angled surface 160 on the extending arms 153 for clamping the arms to the insulation 125. In an alternative embodiment, cap 154 and housing 141 can be configured for a snap fit, without the need for threads 144 or 156.

Figure 17:
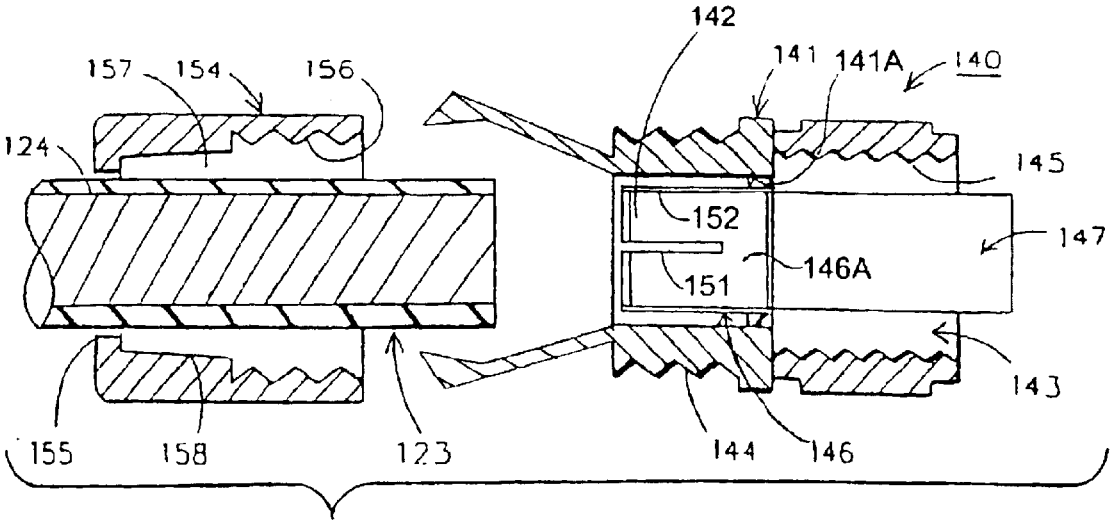
FIG. 17 is a sectional view taken through a third embodiment of an electrical connector of the present invention having an electrical conductor inserted into the connector bore.

A further embodiment of the invention which incorporates the clamping arms of FIG. 10 in the connector of FIG. 15 is shown in FIG. 17. Specifically, the housing 141 is modified to substitute clamping arms 161, including engaging tips 162 similar to those shown in FIG. 10, for the clamping arms 153 of FIG. 15. In this arrangement when the conductor 123 is entered by the hollow prong 146 and fully positioned in the housing 141, the clamping arms 151 can be mechanically clamped on to the insulating layer 125 of the conductor 123. In the arrangement illustrated, the engaging tips 162 are selected so as to engage only the insulating layer 125 and not the center conductor 124, thereby to avoid unwanted electrical conduction from the center conductor 124. Thereafter the cap 154 is placed over the clamping arms 161 and secured to the housing 141, holding the conductor 123 in an irremovable position unitary with the housing 141. Circumstances might arise where it is desired that the engaging tips 162 pierce the insulating layer 125 and engage the center conductor 124 in order to support electrical conduction with the hollow prong 146. In that case the housing can provide a conductive path between the clamping arm 161 and the hollow prong 146 and insulating shielding can be provided for preventing the housing from being electrically shorted.

Again, once insulated conductor 123 is engaged with connector 140, there are a variety of designs which can be used to engage connector 140 with external apparatus to create electrical contact between conductor 124 and the external apparatus. For example, prong 147 can be the same diameter as conductor 124 or can smaller or larger, as desired. Other designs would be readily apparent to a person skilled in the art having the benefit of the subject disclosure.

The method of the present invention involves coupling an electrical connector in accordance with the subject invention to an insulated electrical conductor. Examples of such electrical connectors are shown in FIGS. 11–14 and FIGS. 15 and 16. The end of an insulated electrical conductor 123 is guided to the connector housing such that the hollow portion of the center prong squeezes between the center conductor and insulation layer 125. Accordingly, center conductor 124 makes electrical contact with prong 120 or 122. With respect to a coaxial cable, clamping arms 113 can then be pushed onto insulation layer 129 to drive the gripping tips 133 into the insulation to make electrical contact with conductor 127. With respect to an insulated conductor having a single conductor, arms 153 in FIGS. 15 and 16, can be pushed onto the insulation for holding the electrical conductor to the connector. The connectors shown in FIGS. 11–16 can, for example, be manually clamped with a person's fingers, clamped with a clamping tool such as pliers, and/or clamped via a closure cap for pressing arms 153 to the insulation. A closure cap 154 can also be used to drive the clamping arms 153 against the insulation, as shown in FIGS. 15 and 16. Such a closure cap 154 can be designed to fit over tips 133 after tips 133 have been clamped such that cap 154 can push tips 133 a bit further into the insulation and then hold tips 133 in such position.

Figure 18:
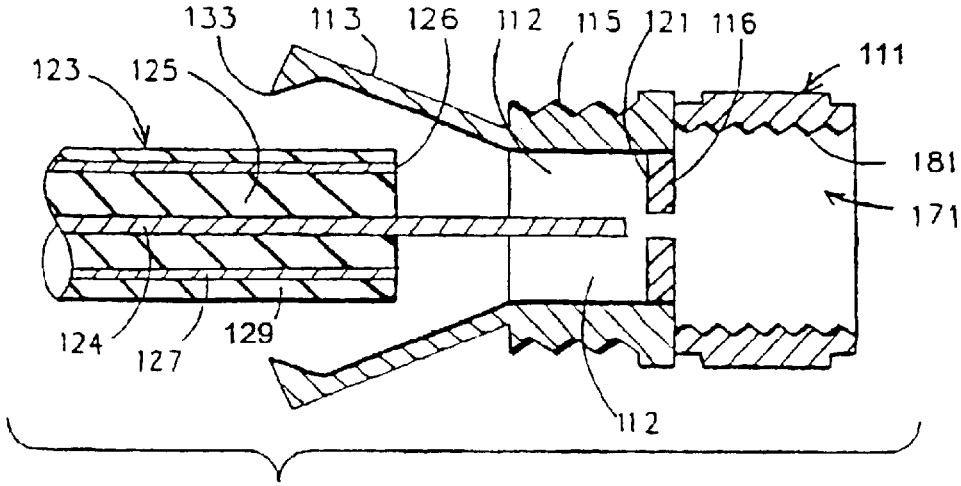
FIG. 18 is a sectional view taken through an embodiment of an electrical connector of the present invention having an aperture in the insulated base through which a protruding inner conductor of a coaxial cable can pass.
Figure 19:
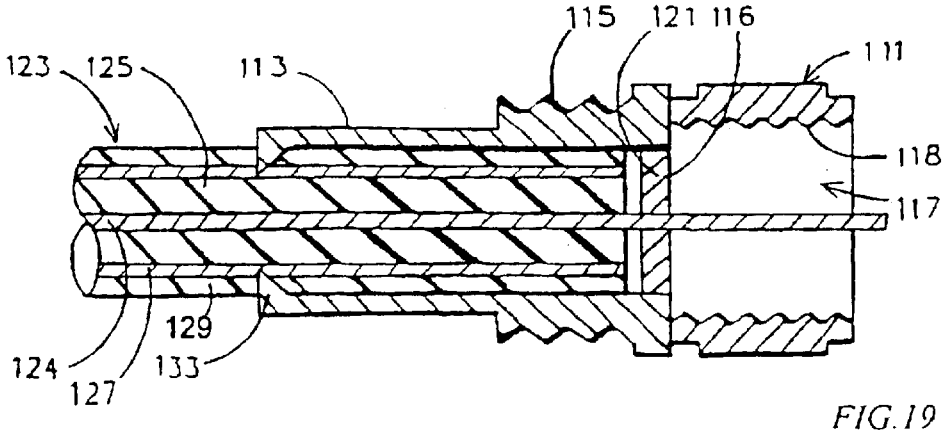
FIG. 19 is a sectional view of the electrical connector of FIG. 18 having an electrical conductor attached thereto.

Referring to FIGS. 18 and 19, an embodiment of the subject invention is shown which utilizes the inner conductor of a coaxial cable to make electrical contact between the coaxial cable, having the subject electrical connector connected, and other connectors or insulated electrical conductors. The coaxial cable can be stripped such that the end of the cable is flush with the exception of the protruding inner conductor. The coaxial cable can then be inserted into the subject connector such that the protruding inner conductor passes through an aperture in insulating base 121 and into bore 117. The clamping arms 113 can then be positioned such that electrical contact with conductive sheath 127 is made. If desired, an appropriate means to secure the clamping arms 113 in place can be used to ensure electrical contact with the conductive sheath 127 is maintained. In addition, if desired, a portion of conductive sheath 127 and outer insulation layer 129 can be stripped, and the aperture in base 121 can be enlarged, such that insulation layer 125 can also pass into the aperture in base 121. In this embodiment, base 121 can be conducting. For example, base 121 can be an extension of the housing, such that insulation layer 125 functions to insulate the inner conductor of the coaxial cable from the housing.

A hollow segmented center conductive prong in accordance with the subject invention can advantageously provide an improved connection between a connector and an insulated conductor and can accommodate different types and sizes of conductors. In particular, a hollow segmented center prong can enhance the contact made with a solid center conductor. However, the present invention should not be construed as limited to the forms shown which are to be considered illustrative rather than restrictive.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. An electrical connector for coupling to an electrical conductor having an inner conductor enclosed with an inner insulation and a generally concentric conductive sheath and enclosed in an outer insulation, said electrical connector comprising:

a housing having an electrically conductive portion;

an electrically conductive prong, wherein at least a portion of said prong is hollow for receiving the inner conductor of the electrical conductor, wherein said hollow portion of said prong comprises a plurality of slits which extend a length of the hollow portion of said prong which receives the inner conductor, wherein said plurality of slits create a plurality of prong segments; and at least one conductive clamping arm connected to said electrically conductive portion of said housing and insulated from said electrically conductive prong, said at least one conductive clamping arm having an end for driving through an outer insulation layer of the electrical conductor and making electrical contact with the conductive sheath of the electrical conductor without contacting the inner conductor.

2. The electrical connector according to claim 1, wherein at least one slit allows the first end of the prong to expand upon receiving an inner conductor of the electrical conductor.

3. The electrical connector according to claim 1, wherein said prong is hollow extending from a first end of said prong and hollow extending from a second end of said prong such that the first end of said prong can receive the inner conductor of the electrical conductor and the second end of said prong can receive an inner conductor of an additional electrical conductor to which the electrical conductor is to be coupled.

4. The electrical connector according to claim 1, wherein said prong is hollow extending from a first end of said prong and solid extending from a second end of said prong such that the first end of said prong can receive the inner conductor of the electrical conductor and the second end can electrically contact an external apparatus to which the electrical conductor is to be coupled.

5. The electrical connector according to claim 1, further comprising an insulating base which attaches said prong to the housing and insulates said prong from the housing.

6. The electrical connector according to claim 1, wherein an edge of the prong is sharpened.

7. The electrical connector according to claim 1, wherein an edge of the prong is beveled.

8. The electrical connector according to claim 1, further comprising:

means for maintaining said at least one conductive clamping arm in position, wherein once the end of each of said at least one conductive clamp is driven through the outer insulation layer of the electrical conductor making electrical contact with the conductive sheath, said means for maintaining said at least one conductive clamping arm in position is positioned to maintain said at least one conductive clamping arm in position such that said at least one conductive clamping arm maintains electrical contact with the conductive sheath.

9. The electrical connector according to claim 8, wherein said means for maintaining said at least one conductive clamping arm in position slides over said conductive clamping arms and locks into place.

10. The electrical connector according to claim 8, wherein said means for maintaining said at least one conductive clamping arm in position comprises an o-ring such that said means for maintaining said at least one conductive clamping arm in position resists moisture.

11. The electrical connector according to claim 8, wherein said means for maintaining said at least one conductive clamping arm in position comprises a sleeve which fits over said at least one conductive clamping arm.

12. The electrical connector according to claim 8, wherein said means for maintaining said at least one conductive clamping arm in position comprises molded plastic.

13. The electrical connector according to claim 8, wherein said means for maintaining said at least one conductive clamping arm in position comprises a rubber molded covering.

14. The electrical connector according to claim 8, wherein said means for maintaining said at least one conductive clamping arm in position comprises a heat shrink material.

15. The electrical connector according to claim 8, wherein said means for maintaining said at least one conductive clamping arm in position is a snap-on cap.

16. The electrical connector according to claim 15, wherein said snap-on cap comprises a lip which settles into an indentation on said housing.

17. The electrical connector according to claim 8, wherein the means for maintaining the at least one conductive clamping arm in position is a threadable cap.

18. The electrical connector according to claim 17, wherein said threadable cap comprises internal threads which removably thread onto external threads on said housing.

19. The electrical connector according to claim 1, wherein said electrical connector comprises a plurality of conductive clamping arms, and wherein the ends of the plurality of conductive clamping arms are pointed.

20. The electrical connector according to claim 19, wherein upon driving the pointed ends of said plurality of conductive clamping arms through the outer insulation layer and making electrical contact with the conductive sheath of the electrical conductor, a first side of each conductive clamping arm contacts a second side of an adjacent conductive clamping arm such as to prevent further penetration of each conductive clamping arm's pointed end.

21. The electrical connector according to claim 20, where the pointed end of each conductive clamping arm is curved such that when the first side of each conductive clamping arm contacts the second side of an adjacent conductive clamping arm, the curved pointed ends of the conductive clamping arms forms a circular pattern.

22. The electrical connector according to claim 19, wherein a first surface of each conductive clamping arm from which the pointed end extends contacts the outer insulation layer of the electrical conductor so as to assist in holding the electrical conductor in place with respect to said electrical connector.

23. The electrical connector according to claim 22, wherein said first surface is textured such as to increase the frictional forces between said first surface and the outer insulation layer of the electrical conductor.

24. The electrical connector according to claim 22, wherein said first surface is curved to match the curve of the outer insulation layer of the electrical conductor.

25. The electrical connector according to claim 22, wherein the pointed end of each conductive clamping arm extends from said first surface such that when said first surface contacts the outer insulation layer the pointed end contacts but does not penetrate the conductive sheath of the electrical conductor.

26. The electrical connector according to claim 22, wherein the pointed end of each conductive clamping arm extends from said first surface such that when said first surface contacts the outer insulation layer the pointed end just penetrates through the conductive sheath of the electrical conductor.

27. An electrical connector for coupling to an electrical conductor having an inner conductor enclosed with an inner insulation and a generally concentric conductive sheath and enclosed in an outer insulation, said electrical connector comprising:

a housing having an electrically conductive portion, wherein said housing comprises a first bore for receiving an end of the electrical conductor and a second bore for receiving an end of an additional electrical conductor;

an electrically conductive prong, wherein at least a portion of said prong is hollow for receiving the inner conductor of the electrical conductor; and at least one conductive clamping arm connected to said electrically conductive portion of said housing and insulated from said electrically conductive prong, said at least one conductive clamping arm having an end for driving through an outer insulation layer of the electrical conductor and making electrical contact with the conductive sheath of the electrical conductor without contacting the inner conductor.

28. An electrical connector for coupling to an electrical conductor having an inner conductor enclosed with an inner insulation and a generally concentric conductive sheath and enclosed in an outer insulation, said electrical connector comprising:

a housing having an electrically conductive portion;

an electrically conductive prong, wherein at least a portion of said prong is hollow for receiving the inner conductor of the electrical conductor; and at least one conductive clamping arm connected to said electrically conductive portion of said housing and insulated from said electrically conductive prong, said at least one conductive clamping arm each having an end for driving through an outer insulation layer of the electrical conductor and making electrical contact with the conductive sheath of the electrical conductor without contacting the inner conductor, wherein the electrical conductor is designed to receive an end of the electrical conductor that is flush, wherein the hollow portion of the electrically conductive prong penetrates the flush end of the electrical conductor as the hollow portion of the electrically conductive prong receives the inner conductor of the electrical conductor.

29. The electrical connector according to claim 28, wherein said prong has at least one slit, the at least one slit allowing the first end of the prong to expand upon receiving an inner conductor of the electrical conductor.

30. The electrical connector according to claim 28, wherein said prong is hollow extending from a first end of said prong and hollow extending from a second end of said prong such that the first end of said prong can receive the inner conductor of the electrical conductor and the second end of said prong can receive an inner conductor of an additional electrical conductor to which the electrical conductor is to be coupled.

31. The electrical connector according to claim 28, wherein said prong is hollow extending from a first end of said prong and solid extending from a second end of said prong such that the first end of said prong can receive the inner conductor of the electrical conductor and the second end can electrically contact an external apparatus to which the electrical conductor is to be coupled.

32. The electrical connector according to claim 28, further comprising an insulating base which attaches said prong to the housing and insulates said prong from the housing.

33. The electrical connector according to claim 28, further comprising:

means for maintaining said at least one conductive clamping arm in position, wherein once the end of each of said at least one conductive clamp is driven through the outer insulation layer of the electrical conductor making electrical contact with the conductive sheath, said means for maintaining said at least one conductive clamping arm in position is positioned to maintain said at least one conductive clamping arm in position such that said at least one conductive clamping arm maintains electrical contact with the conductive sheath.

34. The electrical connector according to claim 33, wherein said means for maintaining said at least one conductive clamping arm in position comprises an o-ring such that said means for maintaining said at least one conductive clamping arm in position resists moisture.

35. The electrical connector according to claim 33, wherein said means for maintaining said at least one conductive clamping arm in position comprises a sleeve which fits over said at least one conductive clamping arm.

36. The electrical connector according to claim 33, wherein said means for maintaining said at least one conductive clamping arm in position comprises molded plastic.

37. The electrical connector according to claim 33, wherein said means for maintaining said at least one conductive clamping arm in position comprises a rubber molded covering.

38. The electrical connector according to claim 33, wherein said means for maintaining said at least one conductive clamping arm in position comprises a heat shrink material.

39. The electrical connector according to claim 33, wherein said means for maintaining said at least one conductive clamping arm in position slides over said at least one conductive clamping arm and locks into place.

40. The electrical connector according to claim 33, wherein said means for maintaining said at least one conductive clamping arm in position is a snap-on cap.

41. The electrical connector according to claim 40, wherein said housing includes an indentation and said snap-on cap comprises a lip which settles into said indentation on said housing.

42. The electrical connector according to claim 28, wherein said electrical connector comprises a plurality of conductive clamping arms, and wherein the ends of the plurality of clamping arms are pointed.

43. The electrical connector according to claim 42, wherein upon driving the pointed ends of said plurality of conductive clamping arms through the outer insulation layer and making electrical contact with the conductive sheath of the electrical conductor, a first side of each conductive clamping arm contacts a second side of an adjacent conductive clamping arm such as to prevent further penetration of each conductive clamping arm's pointed end.

44. The electrical connector according to claim 43, where the pointed end of each conductive clamping arm is curved such that when the first side of each conductive clamping arm contacts the second side of an adjacent conductive clamping arm, the curved pointed ends of the conductive clamping arms forms a circular pattern.

45. The electrical connector according to claim 42, wherein a first surface of each conductive clamping arm from which the pointed end extends contacts the outer insulation layer of the electrical conductor so as to assist in holding the electrical conductor in place with respect to said electrical connector.

46. The electrical connector according to claim 45, wherein said first surface is textured such as to increase the frictional forces between said first surface and the outer insulation layer of the electrical conductor.

47. The electrical connector according to claim 45, wherein said first surface is curved to match the curve of the outer insulation layer of the electrical conductor.

48. The electrical connector according to claim 45, wherein the pointed end of each conductive clamping arm extends from said first surface such that when said first surface contacts the outer insulation layer the pointed end contacts but does not penetrate the conductive sheath of the electrical conductor.

49. The electrical connector according to claim 45, wherein the pointed end of each conductive clamping arm extends from said first surface such that when said first surface contacts the outer insulation layer the pointed end just penetrates through the conductive sheath of the electrical conductor.

* * * * *